US005190468A

United States Patent [19]

Nichols, III et al.

[11] Patent Number: 5,190,468

[45] Date of Patent: Mar. 2, 1993

[54] RIBBON CABLE CONNECTOR

[75] Inventors: Edward L. Nichols, III, Annapolis, Md.; David A. Jakopin, Washington, D.C.

[73] Assignee: Smart House, L.P., Upper Marlboro, Md.

[21] Appl. No.: 712,535

[22] Filed: Jun. 10, 1991

[51] Int. Cl.[5] ..... H01R 4/24

[52] U.S. Cl. ..... 439/404; 439/492; 439/712

[58] Field of Search ..... 439/391–407, 439/417–419, 492–499, 709–713

[56] References Cited

U.S. PATENT DOCUMENTS

| | | | |
|---|---|---|---|
| 4,209,219 | 6/1980 | Proietto | 439/499 |
| 4,606,595 | 8/1986 | Dola | 439/499 |
| 4,674,819 | 6/1987 | Fujitani et al. | 439/499 |
| 4,758,536 | 7/1988 | Miller et al. | 439/405 |
| 4,938,719 | 7/1990 | Sawai et al. | 439/404 |
| 4,997,388 | 3/1991 | Dale et al. | 439/404 |

*Primary Examiner*—David L. Pirlot

*Attorney, Agent, or Firm*—Cushman, Darby & Cushman

[57] ABSTRACT

An improved ribbon cable connector is described for providing connection between an electrical device and a ribbon cable. Receptacle modules and a splice module having identical outer dimensions are provided for insertion into the cover of a receptacle tap. Each receptacle module contains receptacle sites for insertion of pins from an electrical device. Each receptacle site of the receptacle module is connected to an insulator displacement pin that is used to establish a connection with a conductor of a ribbon cable. A splice module connects pairs of insulator displacement pins together so that two different ribbon cables can be connected together in an efficient manner. Alignment projections on both the receptacle and splice modules allow for precise positioning of the insulator displacement pins within each module with the conductors of the ribbon cable.

23 Claims, 5 Drawing Sheets

RIBBON CABLE CONNECTOR

BACKGROUND OF THE INVENTION

1. Field of the Invention

The present invention relates to an improved ribbon cable connector that provides for electrical connection of a ribbon cable to an electrical device and also provides for splicing two different ribbon cables together.

2. Background of the Invention

It is known that when transmitting power or data signals along different conductors in a ribbon cable, that insulator displacement pins must punch through the insulator material on the ribbon cable and establish electrical contact with the appropriate conductor therein. In order to properly obtain such electrical contact, alignment of the insulator displacement pins with the ribbon cable must be precise. These insulator displacement pins then electrically connect to receptacle sites, into which fits an electrical plug or pin from an electrical device.

U.S. Pat. No. 4,758,536 details one known receptacle for a premise wiring system that provides for the alignment of insulator displacement pins with the appropriate conductors of a ribbon cable. While performing its intended function, the receptacle disclosed in this patent requires a large number of parts to install. It also requires that many insulator displacement pins punch through the insulating material on the ribbon cable at the same time when electrical contact is established between the insulator displacement pins and the electrical conductors of the ribbon cable. Also, no provision for splicing ribbon cables is suggested.

U.S. Pat. No. 4,997,388 describes another system for aligning insulator displacement pins with electrical conductors of a ribbon cable. This patent does provide for splicing together two ribbon cables as well as provides receptacle sites for the attachment of another electrical device. However, in the disclosed electrical tap connector, relatively long electrically conductive bus bars are required to establish the splice between different ribbon cables. Furthermore, a connection from each of these bus bars to an appropriate receptacle site is necessary. While this provides the intended functions, it is quite expensive, as a separate bus bar associated with each different ribbon cable conductor is required in every instance.

SUMMARY OF THE INVENTION

It is an object of the present invention to provide an improved ribbon cable connector.

It is another object of the present invention to provide an improved ribbon cable connector having interchangeable insulator displacement modules that provide for electrical connection of an electrical device to a ribbon cable and also provide for a splicing together two separate ribbon cables.

It is a further object of the present invention to provide insulator displacement modules that can be used on an as-needed basis, thereby reducing the cost of the overall connector.

Furthermore, it is another object of the present invention to provide an insulator displacement module that has the functionality recited in the above objects and also has a structure that allows for simple installation.

The above objects of the present invention are obtained by using a receptacle tap into which a single ribbon cable or two different ribbon cables can be inserted. Different types of insulator displacement modules, such as receptacle modules and splice modules, then fit into cut-out sections of the receptacle tap.

Each receptacle module provides for electrical connection of receptacle sites on a surface of the receptacle module to insulator displacement pins disposed partially within the receptacle module. These receptacle sites are arranged in a predetermined arrangement on a front surface of the receptacle module so that when the receptacle module fits into the appropriate cut-out section of the receptacle tap, electrical contact between the insulator displacement pins of the receptacle module and the appropriate ribbon cable conductors is achieved.

Splice modules, having an identical outer dimension as the receptacle modules, are used for splicing together two different ribbon cables inserted into a single receptacle tap. Two ribbon cables, which are set end to end inside the receptacle tap, are electrically connected together by inserting a single splice module into another cut-out section of the receptacle tap. The splice module contains pairs of insulator displacement pins that are electrically connected together. One of the insulator displacement pins in each pair contacts a single conductor of one ribbon cable, while the other insulator displacement pin of the pair contacts the associated conductor on the second ribbon cable. Therefore, when the splice module containing pairs of electrically connected insulator displacement pins is inserted, electrical contact between the associated conductors of the two ribbon cables is made.

Each of the insulator displacement modules, either the receptacle module or the splice module, is formed having the same outer dimensions. Therefore, for example, if a splice module is not needed, but more receptacle modules are required, such a configuration can be achieved.

Furthermore, each type of insulator displacement module according to the present invention contains alignment projections that ensure all insulator displacement modules insert into the receptacle tap in a proper manner. This helps ensure correct alignment of the insulator displacement pins with the conductors of the ribbon cable.

Thus, the present invention provides for receptacle sites on a surface of a receptacle tap as well as a splicing of two different ribbon cables together in a cost effective manner.

BRIEF DESCRIPTION OF THE DRAWINGS

These and other features of the invention will become more readily apparent upon consideration of the following detailed description of the preferred embodiment in conjunction with the drawings, of which.

DETAILED DESCRIPTION OF THE PREFERRED EMBODIMENT

Figure 1:
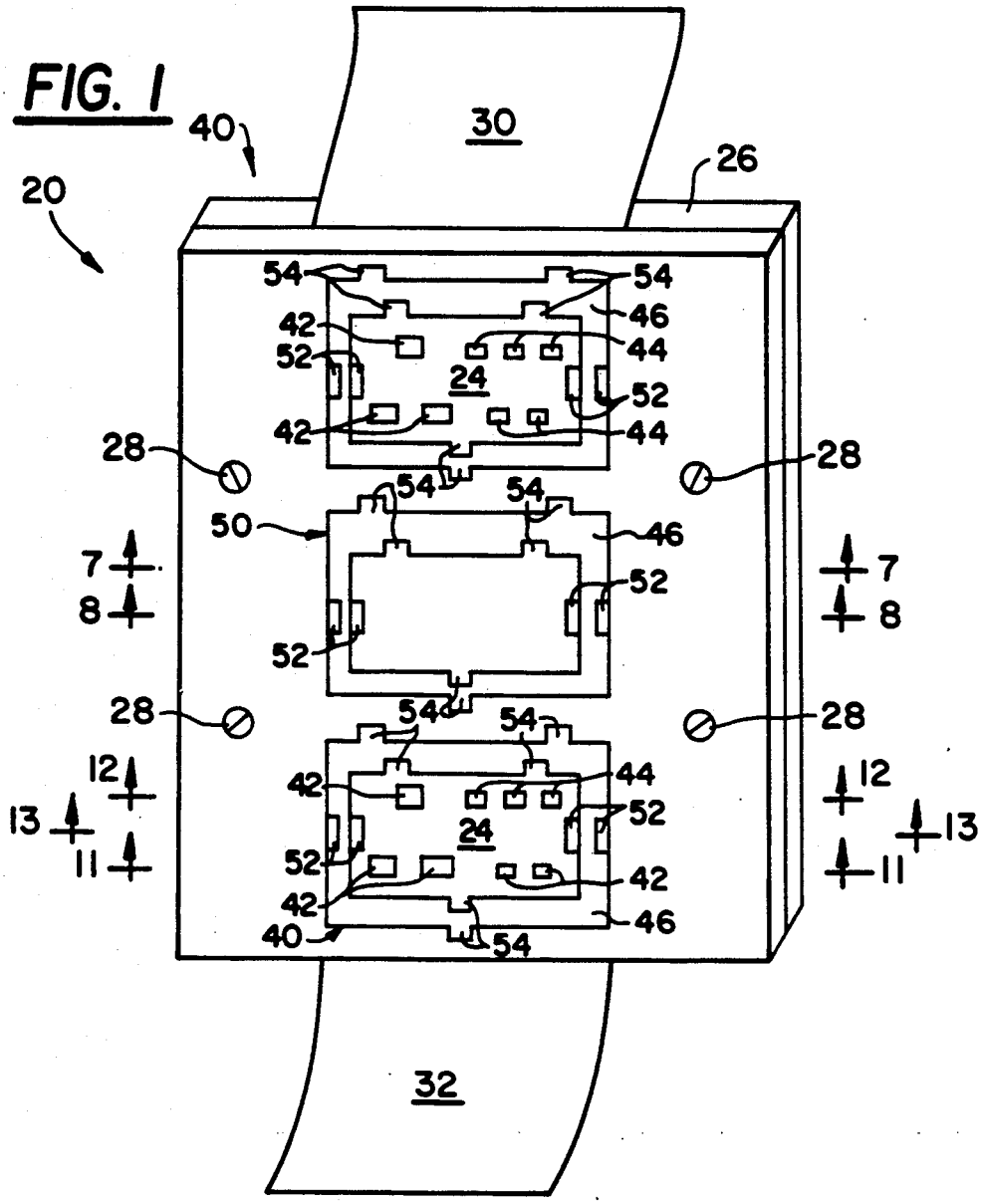
FIG. 1 illustrates a perspective view of the improved ribbon cable connector according to the present invention.

The present invention is intended for use in an environment where an electrical device (not shown) must be connected to a ribbon cable. As illustrated in FIG. 1, the receptacle tap 20 has a cover 22 having a flat front face 24 onto which attached electrical devices (not shown) can rest. The cover 22 attaches to a base 26 with the plurality of fasteners 28, which can be screws or the like.

FIG. 1 illustrates two different ribbon cables 30 and 32 that are each insertable into an opposite side of the receptacle tap 20.

FIG. 1 also illustrates two different receptacle modules 40. Each receptacle module 40 contains a front top surface 42 that aligns with the front surface 24 of cover 22. On the front surface 24 are disposed of plurality of receptacle sites 42 and 44 made of conductive material such as a copper alloy and into which pins of an electrical device (not shown) can be inserted to establish electrical contact between the electrical device and each receptacle sites 42 or 44.

FIG. 1 further illustrates a single splice module 50, which is used to connect the two ribbon cables 30 and 32 together. As described further hereinafter, pairs of insulator displacement pins are electrically connected together so that each conductor of ribbon cable 30 can be connected to an associated conductor of ribbon cable 32.

FIG. 1 also illustrates cable alignment piece 46, used with both receptacle modules 40 and splice module 50. Cable alignment pieces 46 are inserted into the tap cover 22 to precisely align cables 30 and 32 prior to insertion of receptacle modules 40 and splice module 50.

It should also be noted that cable alignment pieces 46, receptacle modules 40 and splice module 50 illustrated in FIG. 1 are all tightly fastened to tap cover 22 after insertion by plastic fasteners 52. Fasteners 52 are shown as plastic clips integrally formed with the supporting structure of cable alignment pieces 46, receptacle modules 40 and splice module 50. Other types of fasteners could be used for the same purpose. Screw fasteners 28 are also illustrated which connect together cover 22 to base 26.

Also, cable alignment pieces 46, receptacle module 40 and splice module 50 contain alignment projections 54, described hereinafter, that allow for the proper and precise insertion of the module into the cover 22 of the receptacle tap.

Figure 2:
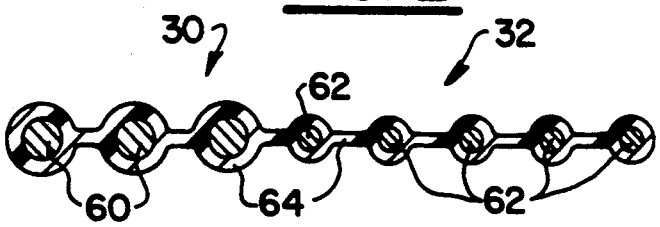
FIG. 2 illustrates a side cross section view of a ribbon cable used with the present invention.

FIG. 2 illustrates the preferred embodiment of the ribbon cables 30 and 32. As shown, a plurality of electrical conductors 60 and 62 made of electrically conductive material such as a copper alloy are disposed within an insulating material 64. The conductors 60 illustrated in FIG. 2 are preferably used for transmission of AC power, whereas conductors 62 are preferably used for transmission of differentially driven digital data and clock signals. Various gauges of wire can be used for conductors 60 and 62 as needed. Furthermore, the numbers of conductors can be varied as needed.

Figure 3A:
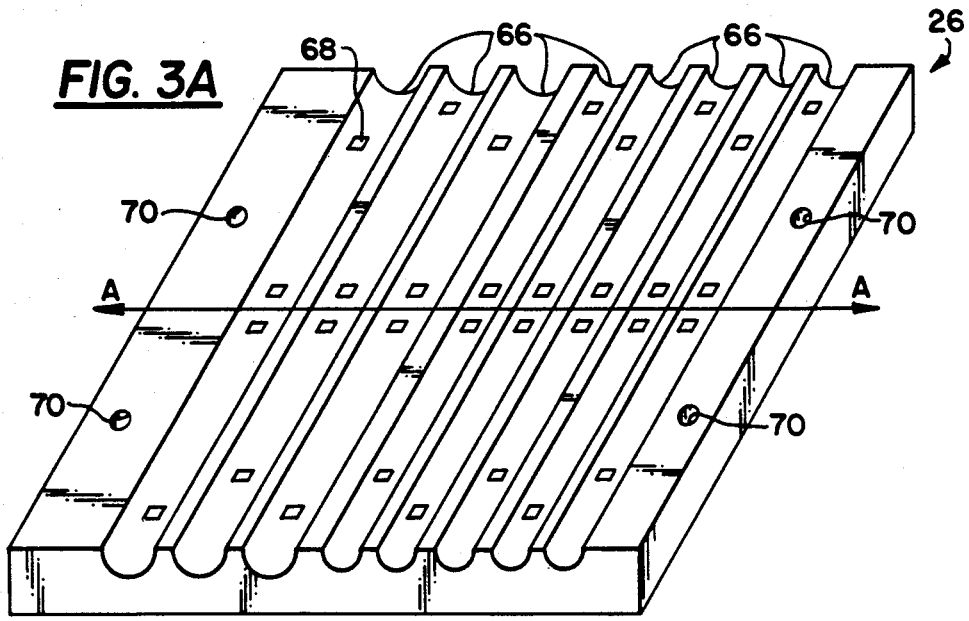
FIG. 3A illustrates a perspective view of the base of the receptacle tap according to the present invention.

FIG. 3A illustrates the base 26 of the receptacle tap 20, which is preferably made from moldable plastic insulating material. As illustrated, a plurality of grooves 66 is required, one for each of the conductors of ribbon cables 30 or 32. This ensures that the ribbon cables 30 and 32 is in approximate proper position when initially inserted into the receptacle tap 20.

Figure 9:
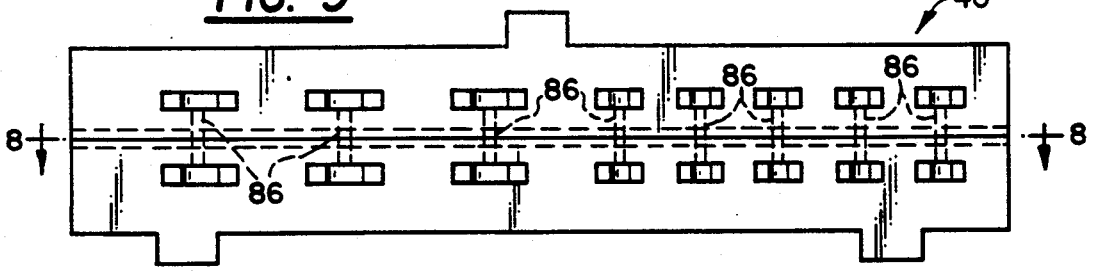
FIG. 9 illustrates a bottom view of the splice module according to the present invention.

When two different ribbon cables 30 and 32 are to be spliced together, one end of each ribbon cable 30 and 32 must be disposed at the location indicated by line A—A in FIG. 3A. FIG. 9 also illustrates the line A—A from a bottom perspective of splice module 40.

Within each groove 66, holes 68 are disposed at predetermined locations where insulator displacement pins will punch through the insulator material 64 of the ribbon cables 30 and 32 to establish electrical contact. Each hole 68 is needed so that the ends of the insulator displacement pins do not bend when fully inserted and their removal at a later time is possible.

FIG. 3A also illustrates holes 70 that are used for connecting the cover 22 to base 26. Such connection is preferably performed in manufacture, so that cables 30 and 32 can slide into the ends of tap 20 at the site where cable attachment takes place.

Figure 3B:
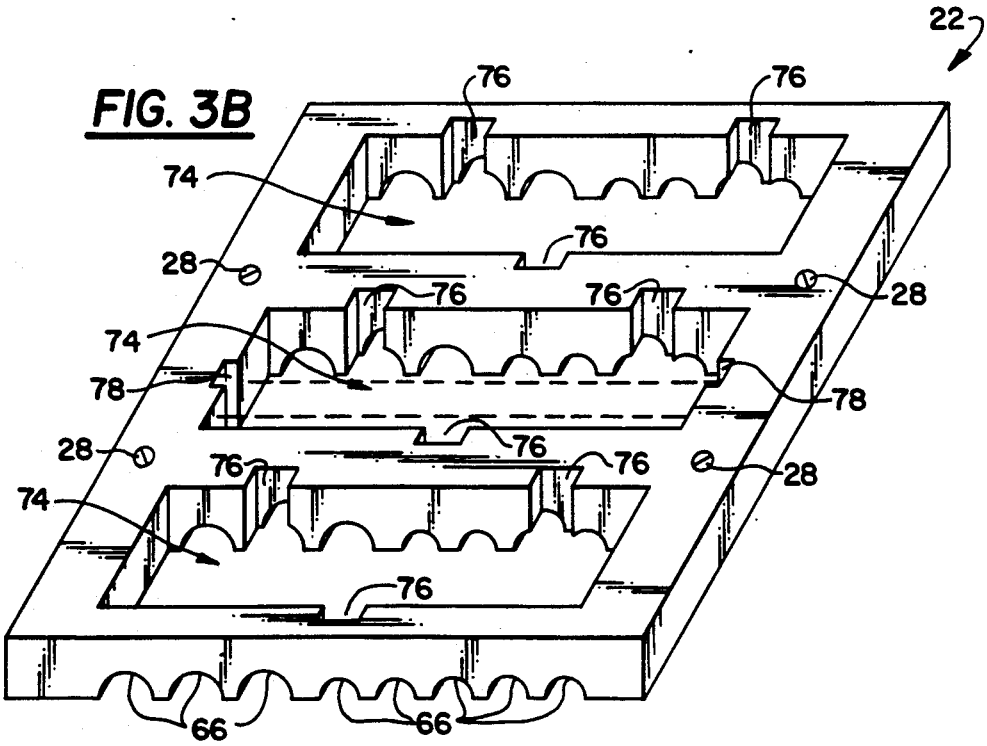
FIG. 3B illustrates a perspective view of the cover of the receptacle tap according to the present invention.

FIG. 3B illustrates cover 22 of the receptacle tap 20, which is also made of moldable plastic insulating material. As illustrated, corresponding grooves 66 are also disposed on the bottom of cover 22 at which location the ribbon cables 30 and 32 will contact the cover 22. As described previously, this ensures approximately proper alignment of the ribbon cables between the base 26 and cover 22 of receptacle tap 20 upon initial insertion.

FIG. 3B illustrates that the cover 22 contains three separate cut-out sections 74. Each cut-out section 74 is preferably identical in outer dimensions. Thus, various different modules 40 and 50, described further hereinafter, can be inserted into the cut-out sections 74.

FIG. 3B also illustrates that each cut-out section 74 contains a pair of projection cut-outs 76 that correspond to alignment projections 54 and ensure proper alignment for insertion of modules 40 and 50. Cut-outs 78 are used for the splice tap module 50, and allow for a splice barrier, illustrated in dotted line, to be inserted when splicing together two ribbon cables. The splice barrier can be removed when no splice is needed.

Figure 4:
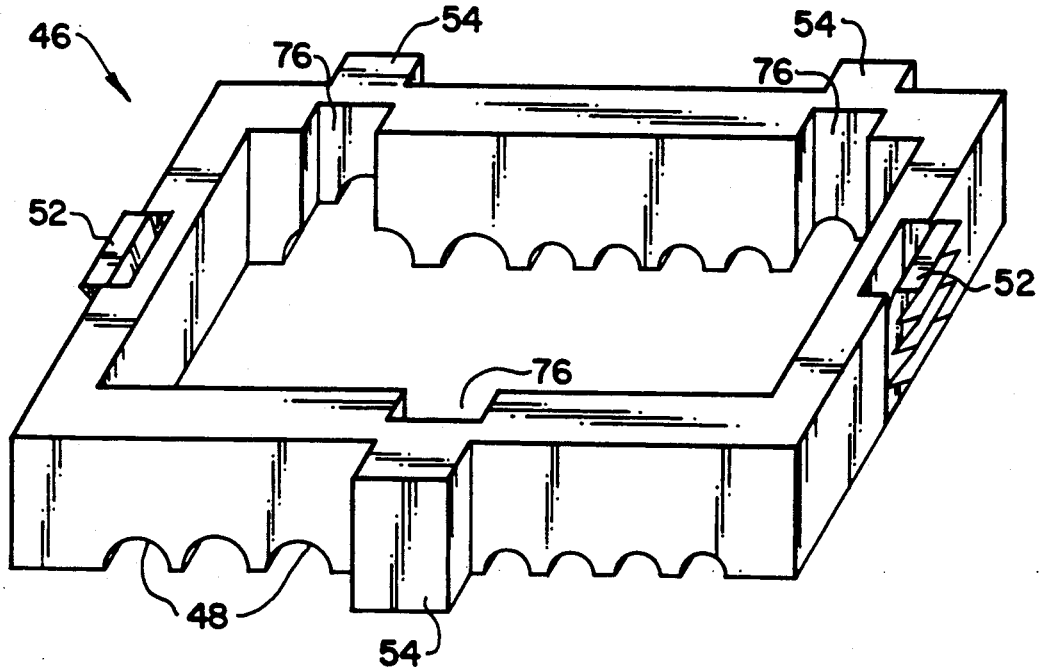
FIG. 4 illustrates a perspective view of the cable alignment piece of the slice and receptacle modules according to the present invention.

FIG. 4 illustrates one cable alignment piece 46, which is used with both modules 40 and 50 and preferably made of molded plastic. Each cable alignment piece 46 contains fasteners 52 that connect together cable alignment pieces 46 to cover 22. As indicated previously, fasteners 52 are preferably formed as an integral part of cable alignment pieces 46.

Grooves 48 of cable alignment pieces 46 are precisely aligned to ensure that when a cable alignment piece 46 is inserted, the cable that is already disposed below in approximately the correct position, will become precisely aligned. This is necessary in order for the positioning of insulator displacement pins, discussed hereinafter.

Figure 5:
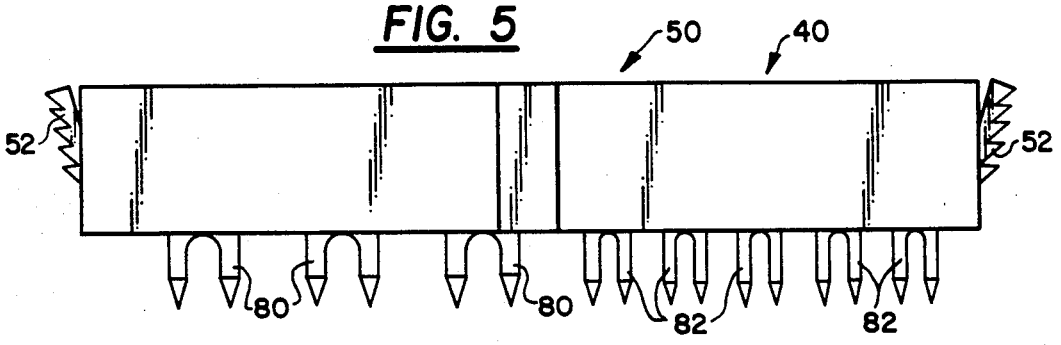
FIG. 5 illustrates a side of the splice and receptacle modules according to the present invention.

FIG. 5 illustrates a side view of either receptacle module 40 or splice module 50. In side view, each of these modules appear identical if all the insulator displacement pins 80 and 82 are used. Each of the insulator displacement pins 80 and 82 are made of electrically conductive material such as a copper alloy and have a size corresponding to the size of the conductors 60 and 62 within the ribbon cables 30 and 32.

Figure 6:
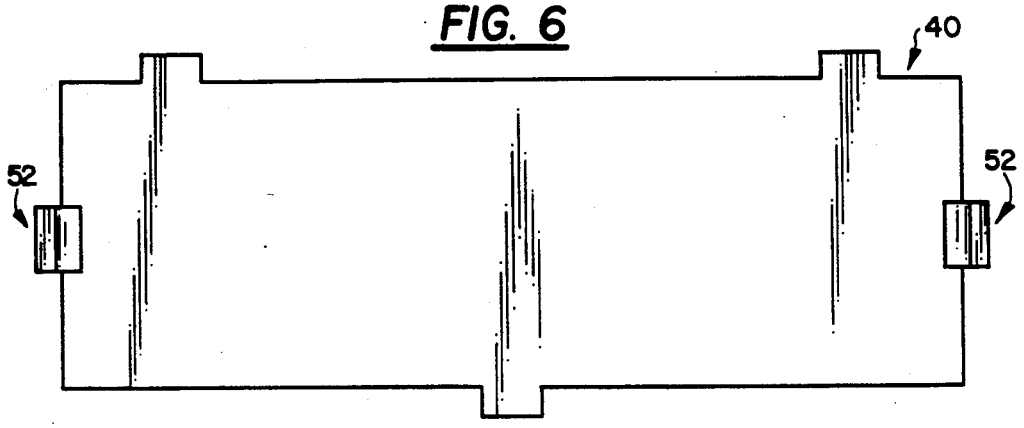
FIG. 6 illustrates a top view of the splice module according to the present invention.

FIG. 6 illustrates a top view of the splice module 40. All that is seen from the top view are the fasteners 52 that establish a connection between the splice module 40 and cable alignment piece 46, which would be previously attached to cover 22 of receptacle tap 20.

Figure 7:
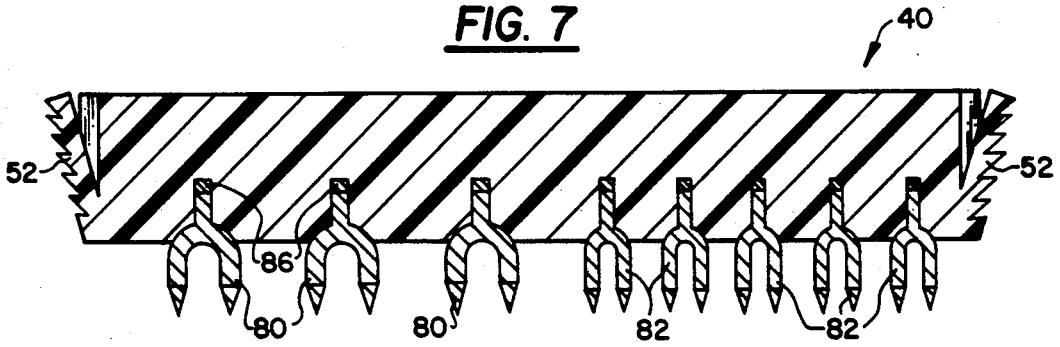
FIG. 7 illustrates a cross section view taken along line 7—7 of FIG. 1 showing the splice module according to the present invention.

FIG. 7 illustrates a cross section view taken along line 7—7 of FIG. 1 of the splice module 40. As illustrated, the various insulator displacement pins 80 and 82 are permanently held in position by the plastic material 84 that electrically insulates each of the paired insulator displacement pins and also forms the outer dimensions of splice module 40. Electrically connected to each of the insulator displacement pins 80 and 82 is a connecting piece 86 formed of electrically conductive material such as a copper alloy that electrically connects together associated pairs of the insulator displacement pins 80 and 82.

FIG. 9, which illustrates a bottom view of the splice module 40, shows in dotted line the connectors 86 disposed within the splice module 40. One pair of insulator displacement pins 80 and 82 are connected via a single electrical connecting member 86 to establish such electrical contact.

Figure 8:
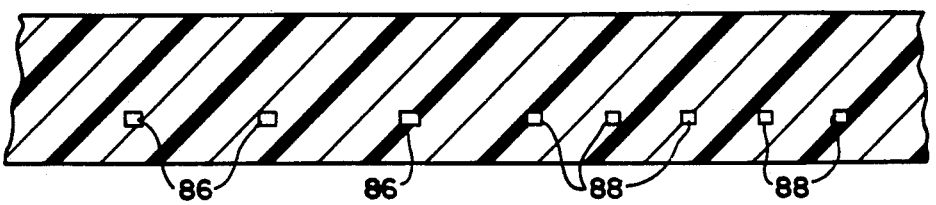
FIG. 8 illustrates a cross section view taken along line 8—8 of FIG. 1 showing the splice module according to the present invention.

FIG. 8 illustrates a cross section taken along line 8—8 of FIG. 1. As illustrated, the electrical connecting members 86 can be seen, as well as holes 88 for insertion of fasteners 28.

Figure 10:
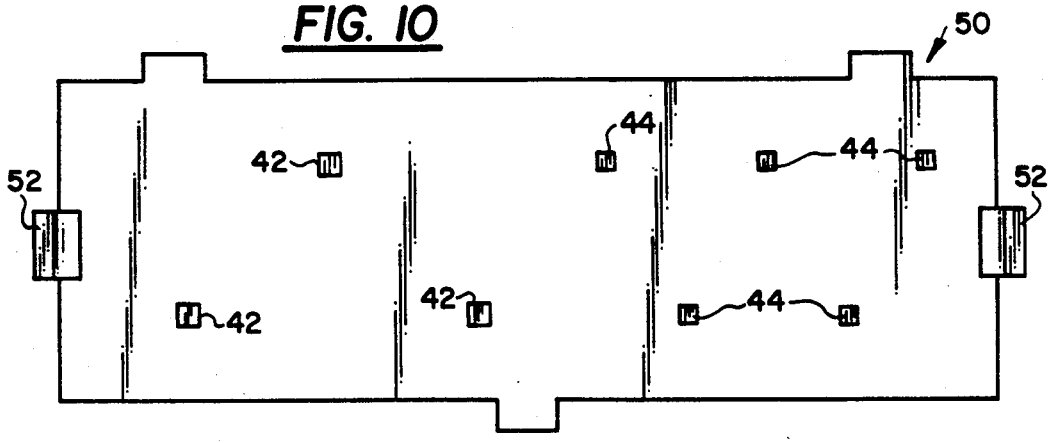
FIG. 10 illustrates a top view of the receptacle module according to the present invention.

FIG. 10 illustrates a top view of the receptacle module 50. As illustrated, receptacle sites 42 and 44 are located at predetermined positions so that pins of an electrical device, (not shown) insert into these receptacle sites.

Figure 11:
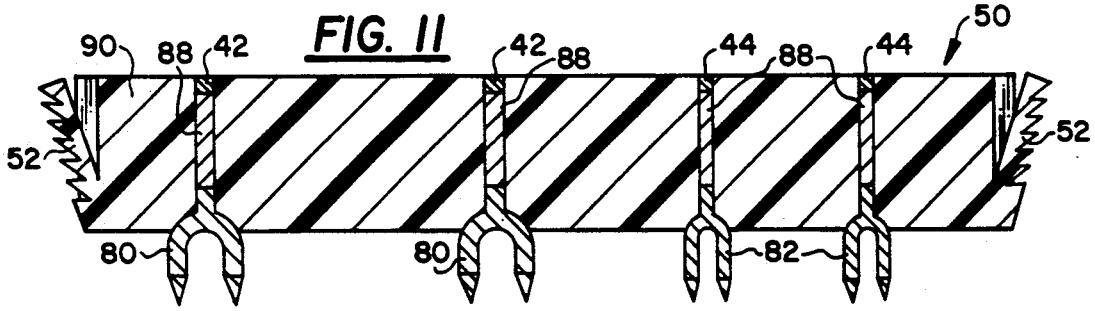
FIG. 11 illustrates a cross section view taken along line 11—11 of FIG. 1 showing the receptacle module according to the present invention.
Figure 12:
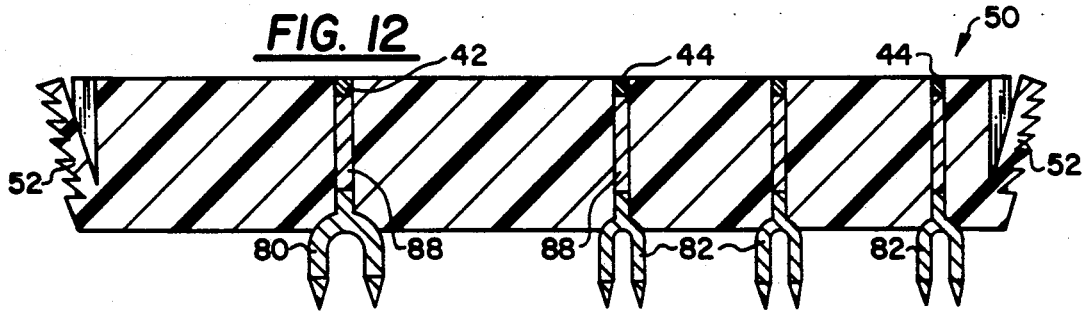
FIG. 12 illustrates a cross section view taken along line 12—12 of FIG. 1 showing the receptacle module of the present invention.

FIGS. 11 and 12 illustrate cross sections of the receptacle module 50 taken along lines 11—11 and 12—12, respectively. As illustrated in both drawing figures, an electrical connection between each of the insulator displacement pins 80 and 82 and the associated receptacle sites 42 and 44, respectively is established via connectors 88 made of electrically conductive material such as a copper alloy.

The receptacle module 50, preferably made of plastic material 90, insulates receptacle sites 42 and 44, connectors 88, and insulator displacement pins 80 and 82 from each other, and forms the outer shape of the receptacle module 50. Thus, insulator plastic material 90 performs the same functions as the plastic material 84 used to make the splice module 40, described previously.

Figure 13:
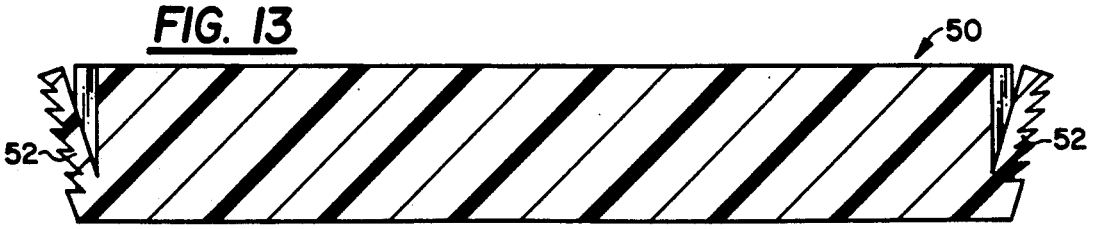
FIG. 13 illustrates a cross section view taken along line 13—13 of FIG. 1 showing the receptacle module according to the present invention.

FIG. 13 illustrates a cross section taken along line 13—13 of FIG. 1 and further illustrates fasteners 52 that allow fastening of the receptacle module 50 to the cable alignment piece 46, which previously would have been connected to cover 22 of the receptacle tap 20.

When assembling the receptacle tap 20 illustrated in FIG. 1, ribbon cables 30 and 32 are properly positioned so that the conductors align with the grooves 66 of the base 26. When this positioning occurs, cover 22 is already connected to base 26 so that grooves 66 of the cover 22 are aligned with the grooves 66 of base 26. Approximate positioning of cables 30 and 32 is then obtained. If two cables are inserted, each cable is fed so that an end of the cable abuts an inserted splice barrier, discussed previously with reference to FIG. 3B.

After the initial positioning of the ribbon cable between the base 26 and the cover 22, the alignment pieces 46, modules 40 and module 50 can be inserted at some later point in time. When the receptacle taps 20 are being used in the construction of buildings using a ribbon cable to transmit AC power and digital data and clock signals, it is advantageous to insert modules 40 and 50 when construction is almost complete, possibly some time after attachment of ribbon cables 30 and 32, to cover 22 and base 26 of the receptacle 20. This ensures that the connection of the various insulator displacement pins within the modules 40 and 50 with the conductors of the ribbon cables 30 and 32 does not take place until after heavy construction has been completed and clean up of most of the debris that such construction creates occurs. By proceeding in this manner, reliable electrical connection between the insulator displacement pins 80 and 82 with the electrical conductors 60 and 62 are ensured.

When it is desired to insert the various receptacle modules 40 and possibly splice module 50, a final alignment of ribbon cables 30 and 32 within the receptacle tap 20 is obtained by first inserting cable alignment pieces 46 into desired cut-out sections 74. Although the cables have previously been aligned using grooves 66, misalignments can occur and proper alignment is absolutely necessary due to the precision needed to establish a reliable electrical contact. Thus, to ensure that the ribbon cables 30 and 32 lay flat against the bottom of the base 26 in a proper position, cable alignment pieces 46, with their precisely aligned grooves 48, provide the positioning necessary, which flattens the cables and accurately aligns each conductor in a groove 48. The installer can then insert any various combinations of receptacle modules 40 and splice module 50.

Although the preferred embodiment illustrates the use of only one splice module 50 and two receptacle modules 40, and also illustrates the splice module 50 at the center position of the receptacle tap 20, other numbers and combinations of modules on a single receptacle tap are properly within the scope of the present invention.

The modules 40 and 50 are inserted and alignment projections 54 help ensure the insulator displacement pins 80 and 82 properly contact the appropriate conductors 60 and 62, respectively, of the ribbon cables 30 and 32. Once the front faces 42 and 56 of the receptacle module 40 and the splice module 50, respectively, are in alignment with the front face 24 of cover 22 of the receptacle tap 20, fasteners 52 cause permanently attachment of the modules 40 and 52 to the cable alignment pieces 46, which have been previously connected to the receptacle tap cover 22.

Once positioned in this manner, pins protruding from the electrical devices (not shown) can be inserted into the receptacle sites 42 and 44 of the receptacle modules 40 and electrical contact between the electrical devices and the ribbon cable is obtained.

Although the invention has been described in connection with a preferred embodiment of the present invention, it should be noted that the invention is not limited to this described embodiment. Modifications of the splice modules and the receptacle modules are possible. For example, a combination splice and receptacle module is properly within the scope of the present invention. Further, the described tap will work for its intended purpose without cable alignment pieces 46, although they are desireable. Accordingly, the present invention is intended to cover all further alternatives, modifications and equivalents may be included within the scope and spirit of the invention as claimed by the appended claims.

What is claimed is:

1. An apparatus for providing electrical interconnection between a ribbon cable having a plurality of conductors and electrical projections of an electrical device comprising:

a cable holder made of insulating material for holding a portion of said ribbon cable substantially flat, said cable holder comprising:

a recessed portion extending from a first opening on one end to a second opening on an opposite end of said cable holder for insertion of said ribbon cable;

a front face; and a cut-out portion formed in said front face and extending to said recessed portion;

a cable alignment piece insertable in said cut-out portion for precisely aligning said ribbon cable, said cable alignment piece comprising an alignment housing having a hollow center area;

at least one receptacle module insertable into said cut out portion, said receptacle module comprising:

a housing made of insulating material insertable into said hollow center area of said inserted cable alignment piece, said housing including a front face;

a plurality of electrically conductive receptacle sites disposed on said front face and adaptable for insertion of said electrical projections of said electrical device to establish electrical connection with said electrical projections;

a plurality of electrically conductive insulator displacement pins partially projecting out of said housing and adaptable for establishing electrical contact with said ribbon cable conductors when said module is inserted into said cut-out portion; and a plurality of electrical conductors disposed within said housing for electrically connecting said insulator displacement pins with said receptacle sites.

2. An apparatus according to claim 1 wherein said recessed portion of said cable holder comprises a plurality of grooves corresponding in number to said plurality of conductors in said ribbon cable.

3. An apparatus according to claim 1 wherein said cable holder further comprises a plurality of holes located in a position corresponding to said plurality of insulator displacement pins to provide an empty space for the projecting portion of said insulator displacement pins when inserted into said ribbon cable.

4. An apparatus according to claim 1 wherein said receptacle module and said cable alignment piece each further comprise alignment projections corresponding in shape to alignment cut-out sections disposed in said cable alignment piece and said cable holder cut out portion, respectively, to ensure precise positioning of said cable alignment piece and said receptacle module.

5. An apparatus according to claim 4 wherein said alignment projections extend outward from said alignment housing of said cable alignment piece and said outer housing of said receptacle module.

6. An apparatus for providing electrical interconnection between end portions of first and second ribbon cables having a plurality of conductors and also interconnection between one of said first and second ribbon cables and electrical projections of an electrical device, comprising:

a cable holder made of insulating material for holding said end portions of said first and second ribbon cables substantially flat, said cable holder comprising:

a recessed portion extending from a first opening on one end to a second opening on an opposite end of said cable holder for insertion of said end portions of said first and second ribbon cables;

a front face; and a plurality of cut-out portions formed in said cable holder front face and extending to said recessed portion;

at least one receptacle module insertable into one of said cut out portions, said receptacle module comprising:

a first housing made of insulating material that insertably fits into one of said cut-out portions, said housing including a first front face;

a plurality of electrically conductive receptacle sites disposed on said first front face and adaptable for insertion of said electrical projections of said electrical device to establish electrical connection with said electrical projections;

a first plurality of electrically conductive insulator displacement pins partially projecting out of said first housing and adaptable for establishing electrical contact with one of said first and second ribbon cable conductors when said receptacle module is inserted into said one cut-out portion; and a first plurality of electrical conductors disposed within said first housing for electrically connecting said first plurality of insulator displacement pins with said first plurality of receptacle sites; and one splice module insertable into another of said cut out portions of said cable holder, said splice module comprising:

a second housing made of insulating material that insertably fits into said another cut-out portion, said housing including a second front face;

a second plurality of electrically conductive insulator displacement pins partially projecting out of said second housing and adaptable for establishing electrical contact with said first and second ribbon cable conductors when said splice module is inserted into said another cut-out portion, said second plurality of insulator displacement pins comprising:

first splice insulator displacement pins adaptable for insertion into said first ribbon cable; and second splice insulator displacement pins adaptable for insertion into said second ribbon cable; and a plurality of electrical conductors disposed within said second housing for electrically connecting each of said first splice insulator displacement pins with a corresponding one of said second splice insulator displacement pins.

7. An apparatus according to claim 6 wherein said first splice insulator displacement pins are arranged in parallel in said second housing and said second splice insulator displacement pins are arranged in parallel in said second housing.

8. An apparatus according to claim 6 wherein said recessed portion of said cable holder comprises a plurality of grooves corresponding in number to said plurality of conductors in said ribbon cables.

9. An apparatus according to claim 6 wherein said cable holder further comprises a plurality of holes located in a position corresponding to said first and second pluralities of insulator displacement pins to provide an empty space for the projecting portion of said insulator displacement pins when inserted into said first and second ribbon cables.

10. An apparatus according to claim 6 wherein said first housing of said receptacle module and said second housing of said splice module have substantially identical outer dimensions.

11. An apparatus according to claim 6 further comprising cable alignment pieces insertable in said cut-out portions for precisely aligning said end portions of said first and second ribbon cables, each said cable alignment piece comprising an alignment housing having a hollow center area adaptable for insertion of one of said receptacle module and splice module and a bottom face having a plurality of grooves corresponding in number to said plurality of conductors in said first and second ribbon cables.

12. An apparatus according to claim 11 wherein said first housing of said receptacle module and said second housing of said splice module have substantially identical outer dimensions and said cable alignment pieces have substantially identical outer dimensions.

13. An apparatus according to claim 11 wherein said receptacle module, said splice module, and said cable alignment pieces each further comprise alignment projections corresponding in shape to alignment cut-out sections disposed in said cable alignment pieces and said cable holder cut-out portions to ensure precise positioning of said cable alignment pieces, said receptacle module and said splice module.

14. An apparatus according to claim 13 wherein said alignment projections extend outward from said alignment housing of said cable alignment pieces and said outer housing of said receptacle and splice modules.

15. An apparatus according to claim 1 wherein said cable alignment piece further includes a bottom face having a plurality of grooves corresponding in number to said plurality of conductors in said ribbon cable.

16. An apparatus according to claim 15 wherein said receptacle module further comprises a front face aligned with said cable holder front face when said receptacle module is inserted into said cut-out portion.

17. An apparatus for providing electrical interconnection between end portions of first and second ribbon cables having a plurality of conductors comprising:

a cable holder made of insulating material for holding said end portions of said first and second ribbon cables substantially flat, said cable holder comprising:

a recessed portion extending from a first opening on one end to a second opening on an opposite end of said cable holder for insertion of said end portions of said first and second ribbon cables;

a front face; and a cut-out portion formed in said cable holder front face and extending to said recessed portion; and one splice module insertable into said cut out portion of said cable holder, said splice module comprising:

a housing made of insulating material that insertably fits into said cut-out portion;

a plurality of electrically conductive insulator displacement pins partially projecting out of said housing and adaptable for establishing electrical contact with said first and second ribbon cable conductors when said splice module is inserted into said cut-out portion, said second plurality of insulator displacement pins comprising:

first splice insulator displacement pins adaptable for insertion into said first ribbon cable; and second splice insulator displacement pins adaptable for insertion into said second ribbon cable; and a plurality of electrical conductors disposed within said second housing for electrically connecting each of said first splice insulator displacement pins with a corresponding one of said second splice insulator displacement pins.

18. An apparatus according to claim 17 wherein said first splice insulator displacement pins are arranged in parallel in said housing and said second splice insulator displacement pins are arranged in parallel in said housing.

19. An apparatus according to claim 17 wherein said recessed portion of said cable holder comprises a plurality of grooves corresponding in number to said plurality of conductors in said ribbon cables.

20. An apparatus according to claim 17 wherein said cable holder further comprises a plurality of holes located in a position corresponding to said first and second pluralities of insulator displacement pins to provide an empty space for the projecting portion of said insulator displacement pins when inserted into said first and second ribbon cables.

21. An apparatus according to claim 17 further comprising cable alignment piece disposed in said cut-out portion for precisely aligning said first and second ribbon cables, said cable alignment piece comprising an alignment housing having a hollow center area adaptable for insertion of said splice module.

22. An apparatus according to claim 21 wherein said cable alignment piece further comprises a bottom face having a plurality of grooves corresponding in number to said plurality of conductors in said first and second ribbon cables.

23. An apparatus according to claim 21 wherein said splice module and said cable alignment piece each further comprise alignment projections corresponding in shape to alignment cut-out sections disposed in said cable alignment piece and said cable holder cut-out portion to ensure said precise positioning of said cable alignment piece and said splice module.

* * * * *